US007219771B2

(12) United States Patent
Augugliaro

(10) Patent No.: US 7,219,771 B2
(45) Date of Patent: May 22, 2007

(54) ELEVATOR COUNTER WEIGHT

(75) Inventor: Dario Augugliaro, Lucerne (CH)

(73) Assignee: Inventio AG, Hergiswil NW (CH)

( * ) Notice: Subject to any disclaimer, the term of this patent is extended or adjusted under 35 U.S.C. 154(b) by 234 days.

(21) Appl. No.: 10/694,459

(22) Filed: Oct. 27, 2003

(65) Prior Publication Data

US 2004/0094371 A1 May 20, 2004

(30) Foreign Application Priority Data

Oct. 29, 2002 (EP) ..... 02405918

(51) Int. Cl.
*B66B 7/06* (2006.01)
*B66B 17/12* (2006.01)

(52) U.S. Cl. ..... 187/405; 187/404

(58) Field of Classification Search ..... 52/731.1, 52/731.2, 737.2, 737.6; 187/404, 405
See application file for complete search history.

(56) References Cited

U.S. PATENT DOCUMENTS

| | | | | | |
|---|---|---|---|---|---|
| 1,509,803 | A | * | 9/1924 | Brown | 187/404 |
| 2,326,783 | A | * | 8/1943 | Kautz | 248/235 |
| 5,033,587 | A | * | 7/1991 | Nakai et al. | 187/289 |
| 5,033,588 | A | * | 7/1991 | Nakai et al. | 187/289 |
| 5,036,955 | A | * | 8/1991 | Nakai et al. | 187/278 |
| 5,074,384 | A | * | 12/1991 | Nakai et al. | 187/289 |
| 5,080,201 | A | * | 1/1992 | Yoo et al. | 187/404 |
| 5,086,881 | A | * | 2/1992 | Gagnon et al. | 187/251 |
| 5,105,109 | A | * | 4/1992 | Nakai et al. | 310/12 |
| 5,300,737 | A | * | 4/1994 | Nakanishi | 187/289 |
| 5,625,174 | A | * | 4/1997 | Ito et al. | 187/289 |
| 5,788,017 | A | * | 8/1998 | Wittur et al. | 187/266 |
| 6,105,798 | A | * | 8/2000 | Gruber et al. | 211/151 |
| 2003/0168290 | A1 | * | 9/2003 | Miyakoshi et al. | 187/405 |

FOREIGN PATENT DOCUMENTS

| | | | |
|---|---|---|---|
| EP | 0 385 255 | | 9/1990 |
| EP | 0 757 659 | | 2/1997 |
| JP | 05162985 | A * | 6/1993 |
| JP | 05201657 | A * | 8/1993 |
| JP | 2000255941 | A * | 9/2000 |
| WO | WO 02/343658 | | 5/2002 |

* cited by examiner

*Primary Examiner*—Patrick Mackey
*Assistant Examiner*—Eric E. Pico

(57) ABSTRACT

An elevator counterweight comprises a counterweight frame constructed from several vertical beams and at least three horizontal crossbars wherein the vertical beams penetrate the horizontal crossbars and form therewith several grid fields in which weight elements are arranged and fixed. The two outermost grid fields disposed above the lowermost horizontal crossbar are open towards the side and can each receive a counterweight guide shoe and a safety brake device.

18 Claims, 3 Drawing Sheets

ELEVATOR COUNTER WEIGHT

BACKGROUND OF THE INVENTION

The present invention relates generally to an elevator counterweight.

Elevator counterweights on the one hand serve the purpose of loading the support means, which drive the elevator car, at the cable end not fastened to the car so that the drive pulley of the elevator drive, over which the support means is looped, can transmit the requisite friction force to the support means. On the other hand, they have the task of providing compensation for a part of the overall load, which is to be moved by the elevator drive and consists of the car weight and the useful load, in order to be able to reduce the required drive power.

Such elevator counterweights are produced in various forms. For example, they can consist of a metal plate or of a container filled with metal scrap or sand. In most cases, however, the elevator counterweight is formed from a metal frame in which metal plates are inserted and fixed.

Elevator counterweights are usually equipped with guide shoes by which they are guided at guide rails mounted in the elevator shaft. Guide shoes can be executed as slide guide shoes or as roller guide shoes.

Since the weight of the elevator counterweight is normally designed so that it is heavier than the empty elevator car, the risk exists, for example in the case of a defect at the drive brake or of a drive gear failure, that the elevator counterweight accelerates the elevator car upwards in uncontrolled manner so that the car hits the ceiling of the elevator shaft. In order to be able to reliably avoid such a situation, elevator counterweights are often equipped with safety brake devices which stop the elevator counterweight and thus also the elevator car when the permissible downward speed is exceeded.

In addition, safety specifications exist which oblige the counterweights of elevator installations to be equipped with safety brake devices when spaces, which can be used, are present below the elevator shaft.

An elevator counterweight with counterweight frame, inserted weight elements, slide guide shoes and safety brake devices is shown in the European patent document EP 0 757 659. As apparent from FIGS. 1 and 2, the counterweight has a simple, rectangular metal profile member frame in which metal plates are held and fixed. At lower extensions of the vertical frame profile members two slide guide shoes are fastened at one side and two safety brake devices are fastened at the other side, which co-operate with associated counterweight guide rails.

Such a construction of an elevator counterweight has certain disadvantages. Guide shoes and safety brake devices are mounted at the outer side of the counterweight frame. This has the consequence that on the one hand the detachable connections between the lower crossbar and the vertical frame profile members, as well as between the latter and the safety brake devices, has to be executed to be very rigid so that the inertia forces and weight forces, which arise during safety braking, of the counterweight can be safely transferred to the safety brake devices and that on the other hand a relatively large intermediate space between the frame and the counterweight guide rails cannot be used for placement of the weight elements. This is the case especially when the guide shoes are constructed as roller guide shoes and, due to the relatively large roller diameter, demand a considerable amount of installation space. Moreover, a significant part of the installation space of the elevator counterweight is lost due to the fact that the space between the lower extensions, which are present for fastening of the guide shoes and the safety brake devices, of the vertical frame profile members cannot be utilized as an installation space for weight elements.

In elevator installations where no safety brake devices are provided at the counterweight, either the lower extensions are too long, so that installation space is wasted, or different extensions are required, which increases the variety of components and the risk of incorrect deliveries.

SUMMARY OF THE INVENTION

The present invention concerns an elevator counterweight of the above-described kind that avoids the stated disadvantages. This means that in the case of an elevator counterweight according to the present invention the safety brake devices are so arranged that the greatest part of the inertia forces of the weight elements are so introduced into the safety braking devices that the detachable connecting elements are only lightly loaded by these inertia forces, that the guide shoes as well as the safety brake devices are so mounted at the counterweight frame that the installation space demanded by the elevator counterweight is utilized in an optimum manner for the installation of a maximum quantity of counterweight elements, that the elevator counterweight is of modular conception in such a manner that with a minimum number of variants of a minimum number of basic components, elevator counterweights can be assembled for the entire useful load range and that the elevator counterweight can be adapted in optimum manner to the presence or absence of safety brake devices.

Vertical beams consisting of several individual profile members, for example of U-shaped profile beams arranged in pairs, are regarded in the following description as a unit.

A particularly space-saving form of embodiment of the present invention results from the fact that a safety brake device can be arranged in each of the two grid fields open towards the side.

In a preferred embodiment of the present invention the vertical beams and horizontal crossbars substantially forming the counterweight frame are so designed that in each instance the vertical beams penetrate the horizontal crossbars or the horizontal crossbars penetrate the vertical beams, wherein the vertical beams are connected with the horizontal crossbars at the penetration locations. It is thereby achieved that elevator counterweights with different numbers of grid fields receiving weight elements can be mounted in simplest manner by crosswise pushing of vertical beams and horizontal crossbars into one another and subsequently connecting at the intersection points.

Advantageously at least two vertically differently positioned fastening locations for the second lowermost horizontal crossbar are present in the vertical beams so that the vertical position of that crossbar can be adapted to the height, which is respectively required for the installation of guide shoes and optionally safety brake devices, of the grid fields open towards the side. This enables selection of a standardized elevator counterweight which fulfils requirements with respect to overall weight and presence or absence of safety brake devices with minimum requirement for space and expenditure of material.

According to a particularly advantageous form of embodiment of the present invention the vertical beams consist of profile members with U-shaped cross-section, which comprises two flanges connected by a web. With the exception of the two vertical beams forming the lateral terminations of the elevator counterweight, the vertical beams consist of U-shaped profile members, which are arranged in pairs, with webs virtually bearing against one another. The vertical beams are arranged in a horizontal direction at a spacing from one another approximately by the optionally different lengths of the counterweight elements, so that counterweight elements can be inserted between the vertical beams and layered on one another, wherein these are guided in their horizontal plane in each instance by the webs and flanges of two mutually spaced-apart U-shaped profile members.

According to an advantageous form of embodiment of the elevator counterweight according to the present invention lower roller or slide guide shoes can be fastened above and to the lowermost horizontal crossbar. This has the advantage that no additional supports are required for mounting of the guide shoes, that a counterweight of maximum width can be mounted between given counterweight guides and that the space between the guide shoes can be utilized over the entire height of the elevator counterweight for the arrangement of weight elements.

A particularly advantageous embodiment of the present invention consists in that the safety brake devices can be fastened below the second lowermost horizontal crossbar to horizontal fastening surfaces present thereat. The advantage particularly consists in the fact that in the case of a safety braking process the safety braking forces which result for the major part from the inertia forces and the weight of the weight elements and which act vertically on the second lowermost horizontal crossbar are conducted directly from this horizontal crossbar by way of the horizontal safety brake device fastening surfaces to the safety brake devices and from these to the counterweight guide rails. It is thereby achieved that detachably executed connections within the counterweight frame as well as between the counterweight frame (horizontal crossbar) and the safety brake devices are only lightly loaded by the safety braking forces. Further advantages of this construction consist in that no additional supports are required for the mounting of the safety brake devices, that a counterweight of maximum width can be mounted between counterweight guides with given spacing and that the space between the safety brake devices can be utilized over the entire height of the elevator counterweight for the arrangement of weight elements.

According to a further advantageous development of the elevator counterweight according to the present invention plate-shaped or block-shaped weight elements can be arranged and fixed in all grid fields, which are not occupied by guide shoes or safety brake devices, of the counterweight frame, wherein the vertical beams are so constructed that they serve as horizontal fixing means for the weight elements. The grid-shaped counterweight frame enables use of weight elements with relatively small lengths. This on the one hand has the advantage of an increased flexibility with respect to adaptation of the counterweight dimensions to given restrictions and on the other hand the weight elements can be manipulated with less effort.

A particularly high degree of flexibility with respect to adaptation of the counterweight dimensions to given restrictions is achieved by the fact that the grid fields defined by the arrangement of the vertical beams can have at least two different widths in order to be able to receive weight elements of different lengths.

According to a preferred embodiment of the elevator counterweight according to the present invention the horizontal crossbars comprise two crossbar plates which are arranged in parallel vertical planes spaced apart by the crossbar width and between which the vertical beams are fixed, wherein the crossbar plates have at approximately half height several horizontal slots in which horizontal plates connecting the two crossbar plates are so welded in place that vertical passage openings are left open for the vertical beams and wherein the crossbar plates have, in the region of the vertical beams, vertical slots in which vertical plates connecting the two crossbar plates are so welded in place that the vertical beams can be laterally fixed thereto.

The advantages of this construction of the horizontal crossbars essentially consist in the fact that they can be penetrated by the vertical beams, but nevertheless form sufficiently rigid bending girders. The horizontal and vertical plates functioning as welded-in connection between the crossbar plates plug into slots formed in the crossbar plates and project somewhat beyond the outer surfaces of the crossbar plates. It is thereby achieved that the position of the horizontal and vertical plates, which after mounting also form connecting points between the horizontal crossbars and the vertical beams, are positioned precisely and free of error before the welding and that all horizontal and vertical plates can be welded to the crossbar plates from the upper side of the horizontal crossbar.

A further advantageous embodiment of the elevator counterweight consists in that the vertical plates present in the horizontal crossbars, as well as the vertical beams, have horizontal slots through which a respective horizontal securing plate extends above and/or below the horizontal plates connecting the crossbar plates and overlaps these, the securing plates being connected with the respective two horizontal plates that are involved. With this construction there is created a safety connection which in the case of a fracture or detaching of the releasable connections present between vertical beams and horizontal crossbars ensures that a separation of horizontal crossbars and vertical beams cannot take place.

Advantageously each uppermost and/or lowermost horizontal crossbar has a center horizontal plate which is so designed that it can serve for fastening support cables or counterbalancing cables. Since such a horizontal plate is required in any case for connection of the crossbar plates of the horizontal crossbars, the usually necessary application of support cable and/or balancing cable fastening plates is saved.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
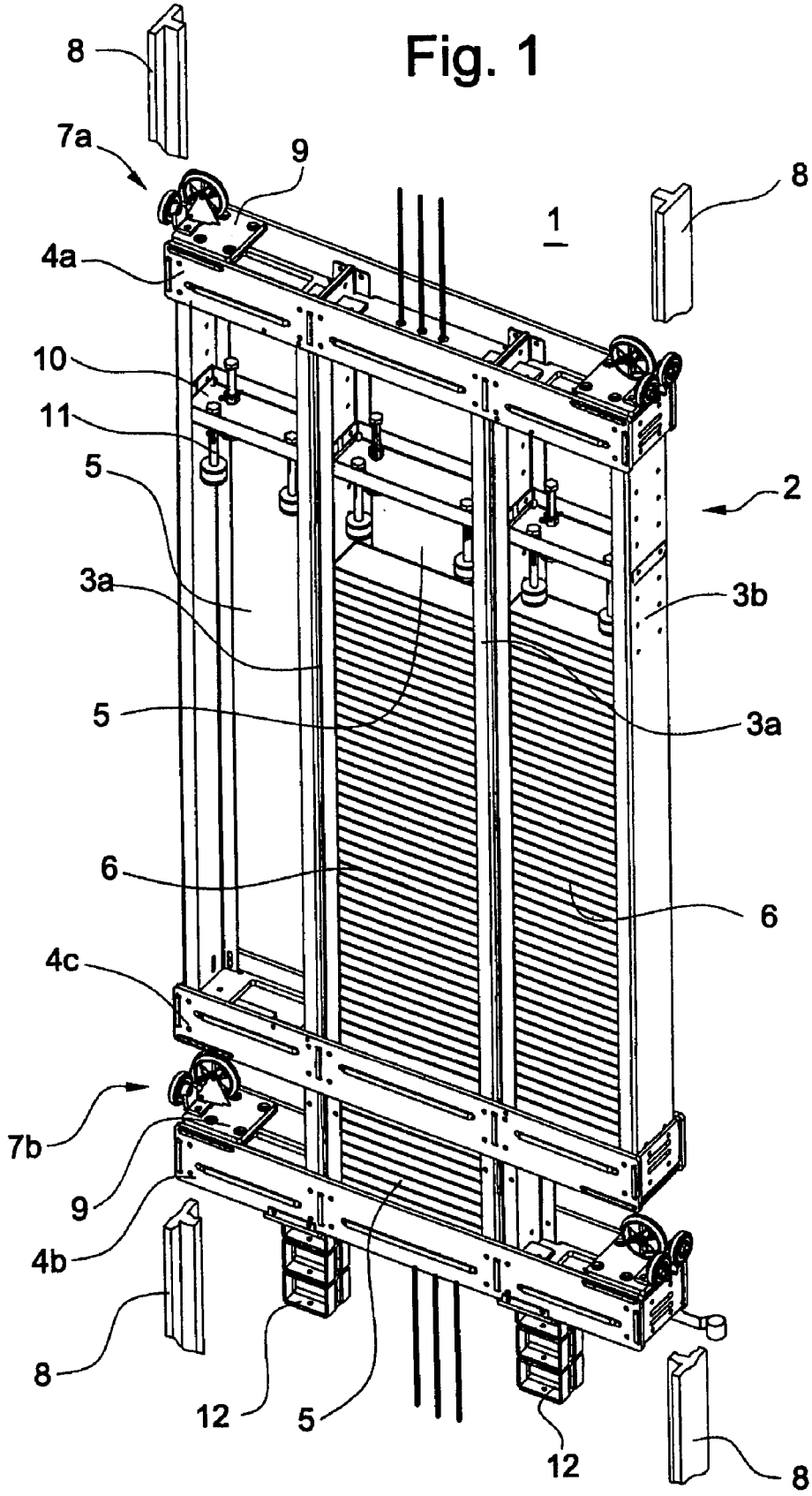
FIG. 1 is a perspective view of an elevator counterweight in accordance with the present invention with four paired or single vertical beams, with roller guide shoes, but without safety brake devices.

FIG. 1 shows a first version of the elevator counterweight 1 according to the present invention with a counterweight frame 2, which comprises four vertical beams 3*a*, 3*b*, an uppermost horizontal crossbar 4*a*, a lowermost horizontal crossbar 4*b* as well as a second lowermost horizontal crossbar 4*c*. The middle vertical beams 3*a* each comprise two U-shaped profile members arranged in pairs, whilst the outermost vertical beams 3*b* each consist of a respective single U-shaped profile member. Vertical beams 3*a*, 3*b* and horizontal crossbars 4*a*, 4*b*, 4*c* are arranged in a common plane to jointly form the grid-shaped counterweight frame 2 having several grid fields 5, which serve for reception of weight elements 6. The horizontal crossbars 4*a*, 4*b*, 4*c* are so designed that the vertical beams 3*a*, 3*b* can penetrate these at predetermined intersection points, wherein horizontal crossbars and vertical beams are connected together in each instance at the intersection points.

The vertical beams 3*a*, 3*b* arranged in pairs or singly consist of U-shaped profile members which each engage by two flanges and the web connecting these around an end of the weight elements 6 inserted in the grid fields 5. Typically, the weight elements 6 are formed as rectangular blocks. The vertical beams 3*a*, 3*b* executed as U-shaped profile members thus ensure horizontal positioning and fixing of the weight elements 6 inserted in the grid fields 5. The counterweight frame 2 is guided at counterweight guide rails 8 by means of roller guide shoes 7*a*, 7*b*. For fastening of the roller guide shoes 7*a*, 7*b* to the counterweight frame 2 the uppermost and lowermost horizontal crossbars 4*a*, 4*b* are equipped in the region of the upper edges of the crossbar ends thereof with guide shoe supports 9, so that the roller guide shoes 7*a*, 7*b* can be arranged each time above the uppermost or lowermost horizontal crossbar. In order to be able to install the lower roller guide shoes 7*b* so that a largest possible part of the installation space of the elevator counterweight 1 is available for the weight elements 6 the lower roller guide shoes 7*b* are each mounted in a respective one of the outermost, lowermost grid fields 5. These outermost, lowermost right-hand and left-hand grid fields are in that case kept open towards the respective counterweight guide rail in that the outermost vertical beams 3*b* extend only from the uppermost horizontal crossbar 4*a* to the second lowermost horizontal crossbar 4*c*. The space 5 between the outermost, lowermost grid fields with the lower roller guide shoes 7*b* can be utilized in this manner for the installation of weight elements 6. The vertical beams 3*a*, 3*b* have at least two fastening locations, which are differently positioned in the vertical direction, for the second lowermost horizontal crossbar 4*c*. This makes it possible to mount the second lowermost horizontal crossbar 4*c* at a different spacing relative to the lowermost horizontal crossbar 4*b*, so that the two grid fields 5 open towards the side can have different heights for the placement of guide shoes with different space requirement or (as shown in FIG. 2) for the additional reception of safety brake devices.

Compression beams which can be fastened between the vertical beams by means of screws and serve the purpose of fixing the stack, which is inserted in the grid fields 5, of weight elements 6 in the vertical direction are denoted by 10. For this purpose the compression girders 10 are equipped with pressure screws 11.

Below the lowermost horizontal crossbar 4*b* there can be mounted buffer supports 12 by way of which the elevator counterweight 1 is supported on counterweight buffers in the event of travelling beyond its lowermost operating position. The buffer supports 12 are composed of several part elements which through removal of individual part elements enable the overall length of the support elements 12 to be adapted to the support means elongation resulting in the course of elevator operation.

Figure 2:
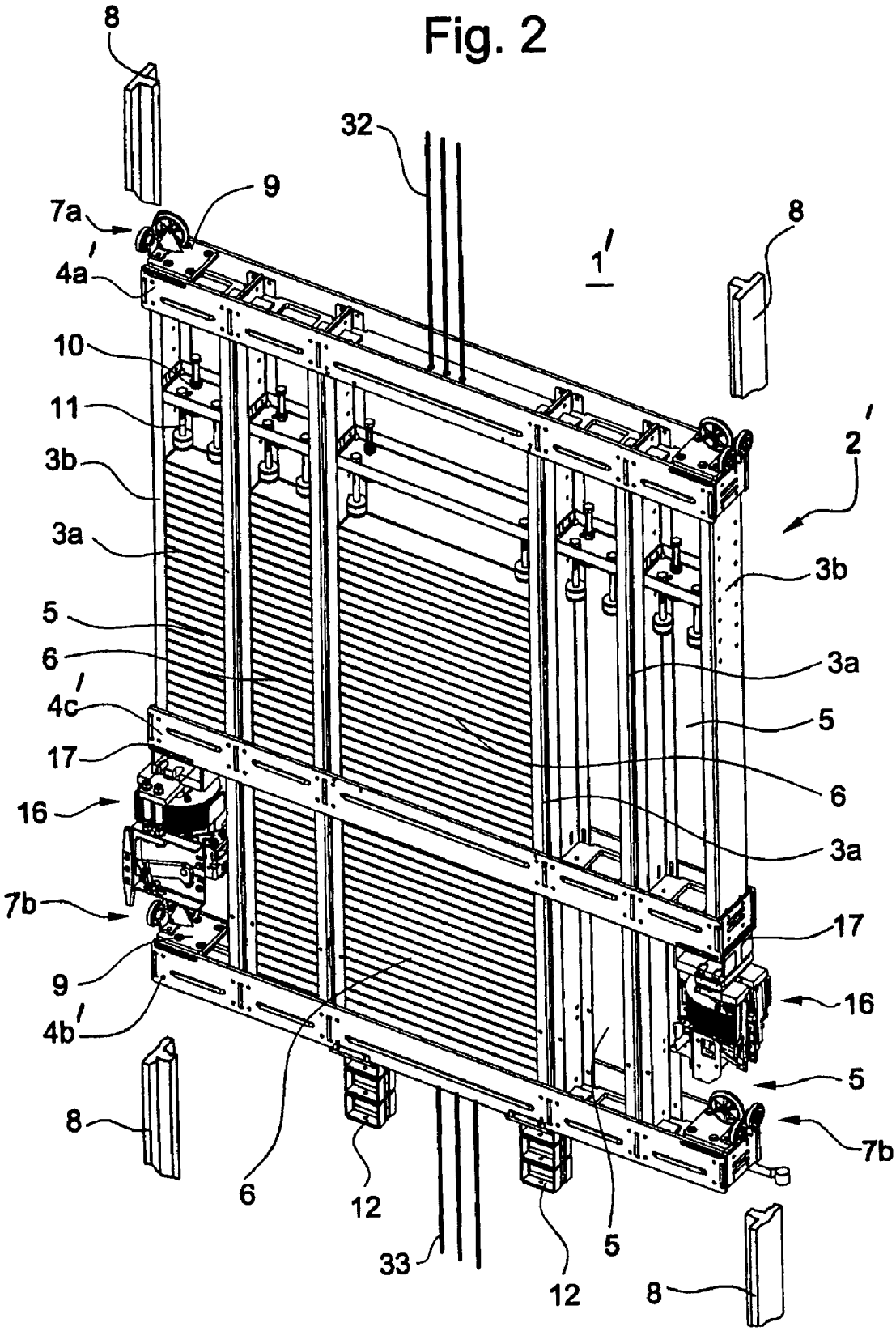
FIG. 2 is a perspective view of an alternate embodiment elevator counterweight according to the present invention with six paired or single vertical beams, with roller guide shoes and with safety brake devices.

FIG. 2 shows a second version of the elevator counterweight 1' according to the present invention, the counterweight frame 2' of which has the same constructional features as the counterweight frame described in conjunction with FIG. 1. This second version similarly comprises a respective uppermost, lowermost and second lowermost horizontal crossbar (4*a*', 4*b*', 4*c*'), as well as the upper and lower roller guide shoes 7*a*, 7*b*, but has six of the vertical beams 3*a*, 3*b* which, together with the horizontal crossbars, form ten grid fields 5, wherein eight grid fields receive weight elements 6 and two grid fields each serve for reception of a respective one of the lower roller guide shoes 7*b* as well as a respective safety brake device 16. The lower right-hand and left-hand grid fields 5 serving for the reception of the roller guide shoe 7*b* and the safety brake device 16 are open towards the side, which is achieved by the fact that the two outermost vertical beams 3*b* extend only from the uppermost horizontal crossbar 4*a*' to the second lowermost horizontal crossbar 4*c*'. In order to have sufficient installation space available for the lower guide shoe 7*b* and the safety brake devices 16 in a vertical direction, the second lowermost horizontal crossbar 4*c*' is mounted in a higher position than is the case with the first version 2. In order to enable an optimum adaptation of the vertical position of the second lowermost horizontal crossbar 4*c*' to the different space requirement of different guide shoes and safety brake devices, the vertical beams 3*a* have at least two, but preferably several, fastening points for the second lowermost horizontal crossbar.

The grid fields 5 preferably have at least two different widths so that counterweights with different lengths can be used. An improved flexibility in use of the elevator counterweight according to the invention is thus achieved, i.e. in the case of given restrictions with respect to specific dimensions of the counterweight frame the available space can be better utilized.

The roller guide shoes 7*a*, 7*b*—obviously also slide guide shoes can be used—are, as in the case of the first version 1, mounted above the uppermost and the lowermost horizontal crossbars 4*a*, 4*b* respectively and are fastened to the guide shoe supports 9 welded in place in the end regions of the horizontal crossbars 4*a*, 4*b*.

In FIG. 2, the safety brake devices 16 are placed below the end regions of the second lowermost horizontal crossbar 4*c*' and fastened to safety brake supports 17 welded there in the second lowermost horizontal crossbar 4*c*'. It is achieved by this arrangement of the safety brake devices 16 that in the case of a safety braking process the braking forces, which result for the major part from the inertia forces and the weight of the weight elements 6 and act on the second lowermost horizontal crossbar 4*c*' are directly conducted from this horizontal crossbar by way of horizontal fastening flanges of the safety brake device supports 17 to the safety brake devices 16 and from these to the counterweight guide rails 8. Detachably constructed connections within the counterweight frame 2', as well as between the counterweight frame (second lowermost horizontal crossbar 4*c*') and the safety brake devices 16, are only lightly loaded by the safety braking forces in the case of this arrangement of the safety brake devices.

In known elevator counterweights the safety brake devices are mounted laterally at the counterweight frame or laterally below the counterweight frame. This reduces the usable width of the counterweight frame and in the case of mounting below the counterweight frame the space between the safety brake devices cannot be utilized.

In the case of the proposed solution the space available for installation of the counterweight can be utilized in optimum manner for installation of the required weight elements.

Figure 3:
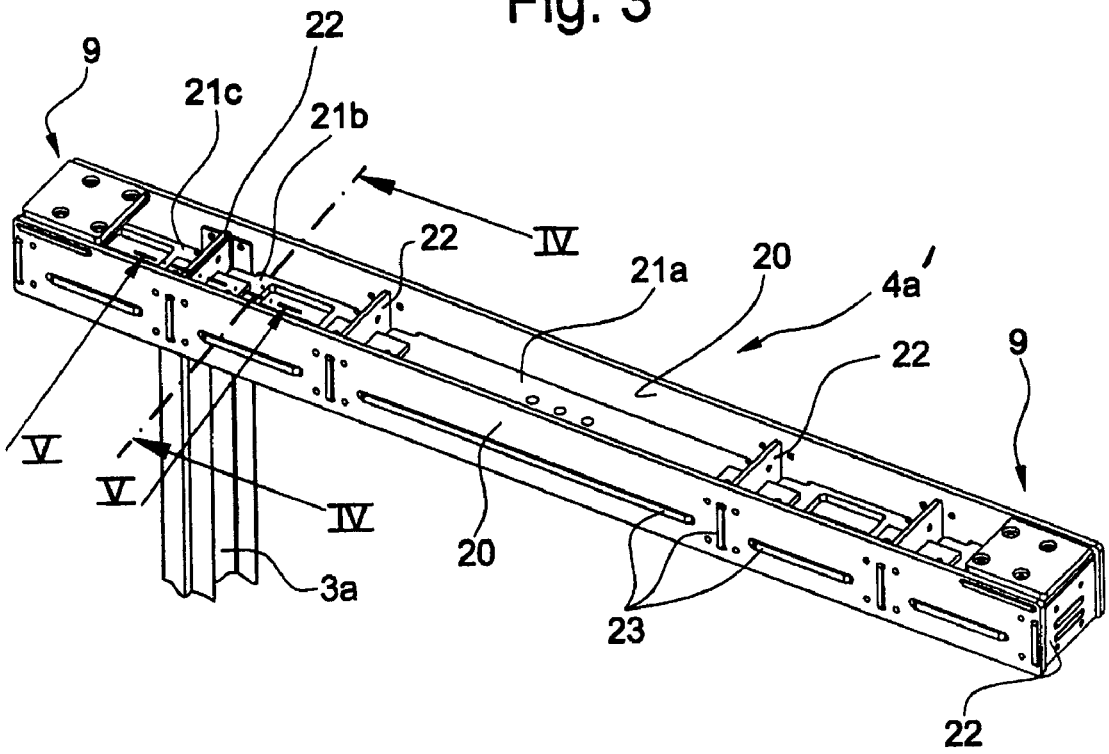
FIG. 3 is a perspective view of the horizontal crossbar shown in FIG. 2 and an intersection point with a vertical beam.
Figure 4:
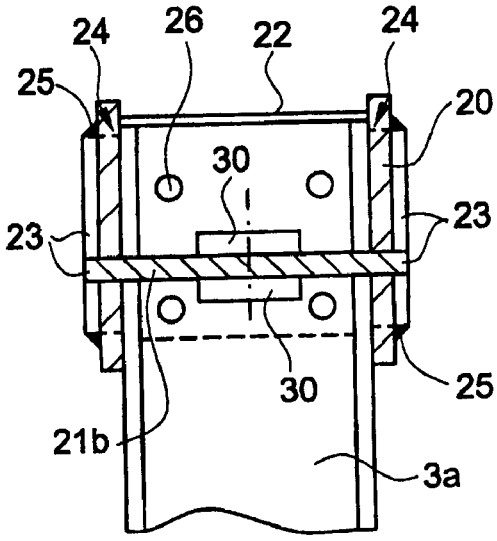
FIG. 4 is a cross-sectional view through the horizontal crossbar taken along the line IV-IV in FIG. 3.

FIG. 3 shows the constructional embodiment of the horizontal crossbar according to the present invention by way of the example of the uppermost horizontal crossbar 4*a*', as well as a crossing and connecting point (intersection point) between this horizontal crossbar and one of the vertical beams 3*a*. FIG. 4 shows a cross-section IV-IV through the horizontal crossbar 4*a*' and FIG. 5 a longitudinal section through the horizontal crossbar, wherein both sections are arranged in the region of the crossing and connecting point with the vertical beam 3*a*. The corresponding components of the counterweight frame 2 of FIG. 1 have a construction similar to that described below.

The horizontal crossbar 4*a*' (and 4*b*', 4*c*') comprises two crossbar plates 20, which are arranged in parallel vertical planes spaced apart by the horizontal crossbar width and which are rigidly connected together by means of several horizontal welding plates 21*a*, 21*b*, 21*c* and several vertical welding plates 22. In the present case, the horizontal welding plates 21*a*, 21*b*, 21*c* are disposed approximately at half height of the crossbar plates 20, wherein in each instance they are spaced so far apart from one another in horizontal direction that the vertical beam 3*a* in paired arrangement can be inserted in the region of the intermediate space. It is obvious that these horizontal welding plates can also be mounted in a different vertical position and that instead of only one respective horizontal welding plate several thereof could be arranged one above the other.

The horizontal welding plates 21*a*, 21*b*, 21*c* and the vertical welding plates 22 plug into horizontal and vertical slots, respectively, which are formed in the crossbar plates 20 and the widths of which correspond with the thickness of the respective welding plates to be inserted. At the sides which are to be plugged into the slots of the crossbar plates the horizontal welding plates and the vertical welding plates have protruding straps 23, the lengths of which are shorter than the length of the sides, wherein these shortened straps are formed in the manner that at the ends of the sides of the welding plates rectangular cut-outs 24 are produced in the welding plates. The slots in the crossbar plates correspond in the length thereof with the length of the protruding straps 23, so that on insertion of the horizontal welding plates and vertical welding plates into the associated slots of the crossbar plates the depth of penetration of the welding plates is defined by the depth of the cut-outs 24. In that case the depth of penetration is selected so that the protruding straps 23 of the horizontal welding plates 21*a*, 21*b*, 21*c* and of the vertical welding plates 22 project by a few millimeters beyond the outer surface of the crossbar plates. It is thereby achieved that along the contours, which protrude beyond the crossbar plates 20, of the protruding straps 23 these straps and thus the associated welding plates can be welded with the crossbar plates 20, wherein all welding seams 25 come to lie on the outer side of the crossbar plates 20. The described method of production of the horizontal crossbars is particularly rational, since on the one hand the positions of the individual components are perfectly fixed after the plugging together and on the other hand all welding seam positions are accessible without problems for welding and also for checking thereof.

Figure 5:
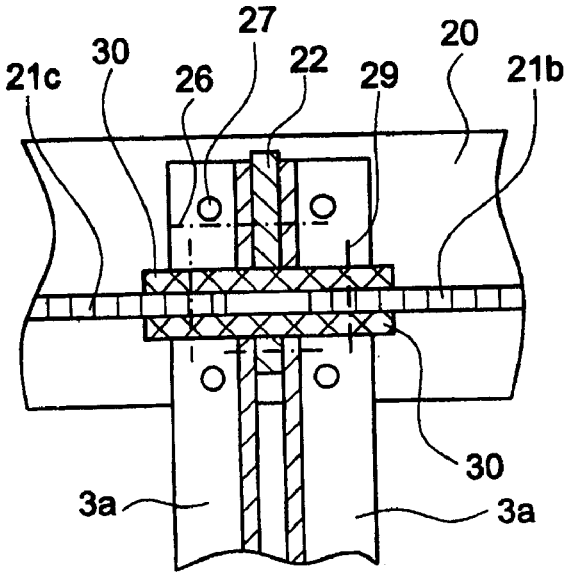
FIG. 5 is a longitudinal section view through the horizontal crossbar taken along the line V-V in FIG. 3.

In FIGS. 3, 4 and 5 it is also recognizable how the vertical beams 3*a*, 3*b*—the vertical beam 3*a* arranged in paired manner is illustrated—are combined and connected with the horizontal crossbars. A respective U-shaped profile beam is inserted on both sides of the vertical welding plate 22, which is associated with one vertical beam, in the intermediate space present between the horizontal welding plates 21*b* and 21*c* and is fastened by its web to the vertical welding plate 22 so that the two U-shaped profile beams together form the vertical beam 3*a* arranged in paired manner. The fastening is preferably carried out by means of screw connections 26, wherein the U-shaped profile beams of the vertical beam 3*a* can additionally be fixed to the crossbar plates 20 by means of further screw connections 27.

The connection between the individual vertical beams 3*b* (not shown here) forming the lateral terminations of the counterweight frame and the horizontal crossbars is effected in analogous manner by fastening the vertical beam 3*b* to the vertical welding plates 22 welded in place in the region of the ends of the horizontal crossbars.

In order to prevent, with the highest degree of security, failure of the connections between the vertical beams 3*a*, 3*b* and the horizontal crossbars 4*a*', 4*b*', 4*c*'—for example, due to impact of the elevator counterweight on its end position limits—additional security can be incorporated at each of the connecting points. For this purpose the vertical beams 3*a*, 3*b* have, in the webs of the U-shaped profile beams forming them, horizontal slots which are so positioned in vertical direction that their horizontal center axes lie at the same height as the center planes of the horizontal welding plates 21*a*, 21*b*, 21*c*. The width of the slots corresponds with the sum of the thicknesses of two securing plates 30 and a horizontal welding plate. The security of the connection between the paired vertical beams 3*a*, which do not form the lateral terminations of the counterweight frame, and the horizontal crossbars is achieved in the manner that a respective securing plate 30 bears against the upper and lower surface of two adjacent horizontal welding plates (for example, 21*b*, 21*c*) and extends through the above-described slot in the vertical beam 3*a*, which is arranged between the mutually spaced-apart horizontal welding plates. The securing plates 30 can in turn be secured in their position by securing elements, for example by screws 29.

The security of the connections between the individual vertical beams 3*b*, which form the lateral terminations of the counterweight frame, and the horizontal crossbars 4*a*', 4*b*', 4*c*' is carried out in analogous manner with the help of securing plates 30, which are fastened only to the respective outermost horizontal welding plates 21*c* of the horizontal crossbars and extend through slots in the outermost vertical welding plates 21*c* and the webs of the outermost vertical beams 3*b*.

In FIG. 3 it is also recognizable that additional welding plates 9, which in the same manner as the already-described horizontal welding plates and vertical welding plates are connected with the horizontal crossbar and serve for fastening the upper guide shoes 7*a*, are present in the upper region of the ends of the horizontal crossbar 4*a*'. Identically disposed welding plates are present at the lowermost horizontal crossbar 4*b*' for fastening of the lower guide shoes 7*b*, and welding plates for fastening the safety brake devices 16 are welded in place in the lower region of the ends of the second lowermost horizontal crossbar 4*c*'.

The horizontal welding plates 21*a* welded in place in the center zones of the uppermost horizontal crossbar 4*a*' and the lowermost horizontal crossbar 4*b*' (FIGS. 1, 2, 3) serve as connection elements for support means 32 or weight compensating means 33 (for example, compensating cables) and for this purpose have suitable bores or connecting elements.

The elevator counterweights in accordance with the invention are constructed according to a modular concept, which provides a minimum number of length and partitioning variants for the predominant components of the counterweight frame 2 (2') in order to enable production of counterweights with optimized dimensions and partitioning. In that case, specific fastening hole groups promoting modularity can be present in multiple form in order to be able to adapt the variants of embodiment to specific conditions of an elevator installation. Examples of that are multiple hole groups for fastening the compression girders 10 and the second lowermost horizontal crossbar to the vertical beams 3*a*, 3*b* at different vertical positions, as well as multiple hole groups in the guide shoe supports 9 and the safety brake supports 17 in order to enable fastening of the guide shoes 7*a*, 7*b* and the safety brake devices 16 of different forms of construction.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator counterweight for connection to an elevator car by flexible support means and movable along counterweight guide rails comprising:

a counterweight frame adapted to be connected to the flexible support means and moved along the counterweight guide rails;

a plurality of weight elements fixed in said frame;

upper and lower guide shoes attached to said frame and adapted to engage the counterweight guide rails; and said frame including at least four vertical beams spaced over a width of said frame and at least three horizontal crossbars attached to said vertical beams, said crossbars extending over the width of said frame, said beams and said crossbars forming at least four grid fields adapted to receive said weight elements with said weight elements being fixed in at least one of said grid fields, said lower guide shoes being attached to an upper surface of a lowermost one of said crossbars.

2. The elevator counterweight according to claim 1 wherein a first one of said crossbars terminates said frame at a top, a second one of said crossbars terminates said frame at a bottom and a third one of said crossbars is arranged between said first and second crossbars, each outermost one of said beams extending only from said first crossbar to said third crossbar so that a lower left-band one of said grids and a lower right-hand one of said grids are open at a respective left-hand side and right-hand side, said lower guide shoes being mounted in said lower left-hand grid and said lower right-hand grid.

3. The elevator counterweight according to claim 2 wherein said third crossbar is fastened to said beams in a selected one of two vertically spaced positions to determine a height of said lower left-hand grid and said lower right-hand grid.

4. The elevator counterweight according to claim 1 wherein said beams and said crossbars are arranged in a common plane.

5. The elevator counterweight according to claim 1 wherein said beams penetrate said crossbars and are connected with said crossbars at penetration locations.

6. The elevator counterweight according to claim 1 wherein said beams are formed with profile members having a U-shaped cross-section.

7. The elevator counterweight according to claim 1 wherein safety brake devices are attached to a lower surface of an intermediate one of said crossbars.

8. The elevator counterweight according to claim 1 wherein said beams prevent horizontal movement of said weight elements in said grids.

9. The elevator counterweight according to claim 1 wherein said weight elements are formed as rectangular blocks.

10. The elevator counterweight according to claim 1 wherein said beams are spaced to define a first width for a first portion of said grid fields and a second width different from said first width for at least a second portion of said grid fields.

11. The elevator counterweight according to claim 1 wherein each said crossbar includes two crossbar plates arranged in parallel vertical planes spaced apart a width of said crossbar and between which said beams are fixed, each said crossbar plate having at approximately half height several horizontal slots formed therein in which horizontal welding plates connecting said crossbar plates are welded such that vertical passage openings are left open for receiving said beams, and wherein said crossbar plates have in a region of said beams vertical slots formed therein in which vertical welding plates connecting said crossbar plates are welded so that said beams are laterally fixed thereto.

12. The elevator counterweight according to claim 11 wherein said vertical welding plates and said beams have horizontal slots formed therein Through which horizontal securing plates extend above and/or below said horizontal welding plates, each said securing plate overlapping an associated one of said welding plates.

13. The elevator counterweight according to claim 1 wherein an uppermost and/or lowermost one of said crossbars has a center horizontal welding plate for fastening support means or weight compensating means.

14. An elevator counterweight for use in an elevator installation comprising:

a counterweight frame including a first plurality of vertical beams spaced over a width of said frame and a second plurality of horizontal crossbars attached to said vertical beams, said beams and said crossbars forming a plurality of grid fields including a lower right-hand grid open at a right side thereof and a Tower left-hand grid open at a left side thereof;

at least one weight element fixed in one of said grids other than said lower right-hand grid and said lower left-hand grid; and a pair of lower guide shoes attached to said frame and adapted to engage the counterweight guide rails, one of said guides shoes being positioned in said lower right-band grid and another of said guides shoes being positioned in said lower left-hand grid, and wherein said lower guide shoes are attached to an upper surface of a lowermost one of said crossbars.

15. The elevator counterweight according to claim 14 wherein safety brake devices are positioned in said lower right-hand grid and said lower left-hand grid and are attached to a lower surface of an intermediate one of said crossbars.

16. The elevator counterweight according to claim 14 wherein said beams and said crossbars are arranged in a common plane.

17. An elevator counterweight for connection to an elevator car by flexible support means and movable along counterweight guide rails comprising:

a counterweight frame adapted to be connected to the flexible support means and moved along the counterweight guide rails;

a plurality of weight elements fixed in said frame;

upper and lower guide shoes attached to said frame and adapted to engage the counterweight guide rails; and said frame including at least four vertical beams spaced over a width of said frame and at least three horizontal crossbars attached to said vertical beams, said beams and said crossbars forming a plurality of grid fields with said weight elements being fixed in at least one of said grid fields, wherein each said crossbar includes two crossbar plates arranged in parallel vertical planes spaced apart a width of said crossbar and between which said beams are fixed, each said crossbar plate having at approximately half height several horizontal slots formed therein in which horizontal welding plates connecting said crossbar plates are welded such tat vertical passage openings are left open for receiving said beams, and wherein said crossbar plates have in a region of said beams vertical slots formed therein in which vertical welding plates connecting said crossbar plates are welded so that said beams are laterally fixed thereto.

18. The elevator counterweight according to claim 17 wherein said vertical welding plates and said beams have horizontal slots formed therein through which horizontal securing plates extend above and/or below said horizontal welding plates, each said securing plate overlapping an associated one of said welding plates.

* * * * *